US005543031A

United States Patent [19]

Okamoto et al.

[11] Patent Number: 5,543,031

[45] Date of Patent: Aug. 6, 1996

[54] METHOD FOR RECOVERING INDIUM BY ELECTROWINNING AND APPARATUS THEREFOR

[75] Inventors: Hidenori Okamoto; Kazuaki Takebayashi, both of Ibaraki-ken, Japan

[73] Assignee: Nippon Mining & Metals Co., Ltd., Tokyo, Japan

[21] Appl. No.: 386,567

[22] Filed: Feb. 10, 1995

[30] Foreign Application Priority Data

Aug. 19, 1994 [JP] Japan ..... 6-195677

[51] Int. Cl.[6] ..... C25C 1/00

[52] U.S. Cl. ..... 205/564

[58] Field of Search ..... 204/105 R, 166; 205/564

[56] References Cited

U.S. PATENT DOCUMENTS

| | | | |
|---|---|---|---|
| 2,052,387 | 8/1936 | Doran | 204/105 R |
| 3,523,880 | 8/1970 | Parsi | 204/104 |
| 4,609,443 | 9/1986 | Nogueira | 204/104 |

FOREIGN PATENT DOCUMENTS

| | | |
|---|---|---|
| 509440 | 6/1951 | Canada . |
| 1-156437 | 6/1989 | Japan . |
| 3-75223 | 3/1991 | Japan . |
| 3-75224 | 3/1991 | Japan . |
| 3-82720 | 4/1991 | Japan . |
| 5-156381 | 6/1993 | Japan . |
| 5-247556 | 9/1993 | Japan . |

*Primary Examiner*—John Niebling
*Assistant Examiner*—Brendan Mee
*Attorney, Agent, or Firm*—Lowe, Price, LeBlanc & Becker

[57] ABSTRACT

In order to recover indium, while preventing generation of chlorine gas, by a direct electrowinning method from a hydrochloric acid solution from which impurities have been removed by various chemical purification methods, an electrolysis is carried out by using an indium-containing hydrochloric acid solution as an electrolyte for a cathode compartment equipped with a cathode comprising an indium starting sheet, by using a sulfuric acid solution in an anode compartment equipped with an insoluble anode and separating the cathode compartment and the anode compartment with a diaphragm of a cation exchange material.

10 Claims, 3 Drawing Sheets

METHOD FOR RECOVERING INDIUM BY ELECTROWINNING AND APPARATUS THEREFOR

BACKGROUND OF THE INVENTION

1. Field of the Invention

The present invention relates to a method for recovering indium by electrowinning and an apparatus therefor, and more particularly to a method for electrowinning of indium from an indium-containing hydrochloric acid solution after removing impurities by various chemical purification methods, and an apparatus therefor.

2. Description of the Art

Industrially, indium has been produced mainly by recovering indium from a byproduct in zinc smelting which contains a small amount of indium, for example, by recovering concentrated indium in a lead sulphate, and therefore a complex hydrometallurgical process has been required for isolating indium from impurities such as arsenic, zinc and cadmium. Generally, indium is recovered as a refined sponge indium by removing impurities to get a high indium content solution through various chemical purification methods in which an acid leaching, neutralization, an alkali leaching, sulphidizing and cementation are combined; and subjecting the high indium content solution to a cementation treatment by using a zinc plate or an aluminum plate. Then, the crude metal is cast to an anode, and electrorefining is carried out by using an indium starting sheet as a cathode and a sulfuric acid solution as an electrolyte so as to produce indium having a purity of 99.99% or more.

FIG. 3 shows a representative process for conventional indium purification.

After raw materials, for example crude metals, are dissolved in hydrochloric acid, $H_2S$ gas is blown into for sulphidizing to precipitate Pb, Cd, Sn or Tl as sulfides. A purified Indium sponge is added to the solution after the sulphidizing to carry out a cementation for precipitating Sn. Further, a cementation with a zinc plate is carried out to precipitate Indium as a purified sponge. Thus obtained purified sponge is cast into an anode and then subjected to an electrorefining to produce an indium product.

The high indium content solution which is obtained through the above chemical purification method has a sufficiently lowered concentration of the impurities so that a high grade indium can be electrowon. However, the indium solution contains hydrochloric acid in order to dissolve the crude metal before the sulphidizing and also promote the isolation of the impurities in the sulphidizing treatment. Therefore, if the solution is directly subjected to an electrowinning, chlorine gas will disadvantageously be generated. In order to avoid generating chlorine gas, it has been required to recover indium first in the form of a refined sponge indium, cast it into an anode and then electrorefine it.

SUMMARY OF THE INVENTION

The present invention has been made in order to overcome problems of prior arts relating to the chlorine gas generation and electrowinning of indium from the hydrochloric acid solution.

The inventors of the present invention intensively studied on a method for recovering an indium product from a indium-containing hydrochloric acid solution from which impurities had been removed by various chemical purification methods without the generation of a chlorine gas and found that in a usual electrowinning method, a chlorine gas is generated at an anode according to the following formula:

$$2\,Cl^- = Cl_2\uparrow + 2e^-,$$

whereas by using a cation exchange membrane to avoid a direct contact of the anode with the hydrochloric acid solution, the transfer of the chlorine ion toward the anolyte can be prevented so that the generation of a chlorine gas at the anode can be prevented. Protons which are released on the anode into the electrolyte solution pass through the cation exchange membrane and form hydrochloric acid in a cathode compartment.

The present invention has been made based on the above findings and relates to a method for recovering indium from indium solution which has been purified by a chemical purification method and also relates to an apparatus therefor, characterized by using a sulfuric acid solution as an electrolyte, i.e. anolyte for an anode compartment equipped with an insoluble anode, using an indium-containing hydrochloric acid solution as an electrolyte, i.e. catholyte for a cathode compartment, and a cation exchange membrane which separates the cathode compartment and the anode compartment so as to conduct an electrowinning.

According to the present invention, a hydrochloric acid solution in which the concentration or impurities is sufficiently lowered by various chemical purification methods can be used as an electrolyte for electrowinning. The indium concentration of the hydrochloric acid solution is not particularly limited and 60 to 150 g/L of indium content is preferred.

An element which is nobler than In, such as Cu, Pb, Sn, Sb and Bi is precipitated on the cathode whereby the purity of the indium is lowered. In order to get a high purity indium having a purity of 99.99% (4N) or more, it is required to reduce the total content of these elements below 15 ppm by a chemical purification method. It is also possible to previously carry out the method of the present invention for the purpose of purification in place of the chemical purification method whereby the noble elements are removed from the catholyte as much as possible and then add the indium-containing hydrochloric acid solution to the catholyte.

In the method for electrowinning of the present invention, in order to avoid the direct contact of hydrochloric acid with the anode and prevent the generation of chlorine gas at the anode, sulfuric acid is used as the anolyte. For decreasing an electrolytic potential, the sulfuric acid concentration of the anolyte is preferably 10 to 180 g/L.

The electrode to be used as the anode in this electrowinning should not be soluble in the sulfuric acid solution, for example, an electrode coated with a platinum group oxide or a platinum electrode can be used as the insoluble electrode which has an excellent acid resistance. As the cathode, a high grade electrorefined indium or electrowon indium is preferably used as a starting sheet. Further, the anolyte is preferably circulated inside and outside the electrolytic cell, for example between the anode component and an anolyte tank which is installed outside the electrolytic cell.

In the method of electrowinning of the present invention, oxygen is generated from the sulfuric acid solution which is used in the anode compartment. If an oxygen gas remains as bubbles in the sulfuric acid solution, the contact area of the anolyte with the anode is decreased with the increase of the current density at the anode and the increase of the cell voltage. Therefore, it is preferred to decrease the cell voltage by promoting the removal of the oxygen gas.

If the removal of the oxygen gas in the circulating solution is promoted, the amount of the oxygen gas which is present in the anolyte can be decreased with the decrease of the cell voltage as well as a good operation can be maintained. It is therefore preferred to set a gas-liquid separation box in the circulation system connected with the anolyte (the anode compartment) and use the gas-liquid separation box in connection with a duct.

When Indium has been recovered from the electrolyte by dissolving the crude sponge indium or by a solvent extraction method, the electrolyte after the electrolysis can be repeatedly used at a pre-step as a stripping solution for solvent extraction, etc. In this case, if the indium concentration of the electrolyte is high, the repeated amount of indium and the materials in the system are increased, and therefore it is desirable to carry out the electrowinning at the indium concentration as low as possible so as to decrease the indium concentration in the electrolyte after the electrowinning. For example, the indium concentration in the catholyte for the electrowinning is preferably 40 g/L or less.

For carrying out the present invention, if dendritical indium is deposited on an cathode-surface because of worsened electrodeposition condition, the indium dendrite will penetrate the cation exchange membrane and the catholyte (the electrolyte) will be mixed with the anolyte having a different solution composition, resulting in generation of a chlorine gas. Therefore it is extremely important to appropriately set the electrolysis condition such as the current density, the kind and amount of additives, the size of the anode compartment and the cathode compartment and the circulation flow rate of the catholyte so that smooth cathode-surface can be maintained.

For example, the inventors have found that when the electrowinning is carried out with the current density of 70 to 100 A/m$^2$ by adding a glue and SAN-EKISU ([sodium lignin sulphonate]: trade name, Nippon Paper Co., Ltd.) as additives in an amount of 6 to 10 g/kg of the electrodeposited indium under sufficient circulation of the catholyte, the electrodeposition can be smoothly carried out. If the amount of the additive exceeds 10 g/kg of the electrodeposited indium, the electrolyte after the electrowinning will be severely bubbled when it is returned to the previous step.

The method for recovering indium and the apparatus therefor of the present invention will be further understood by referring to the drawings attached hereto and the Examples shown below. Any change within the scope of the spirit of the present invention should be included in the present invention.

DETAILED DESCRIPTION OF THE PREFERRED EMBODIMENT

The present invention will be explained below in detail with reference to Examples.

Figure 1:
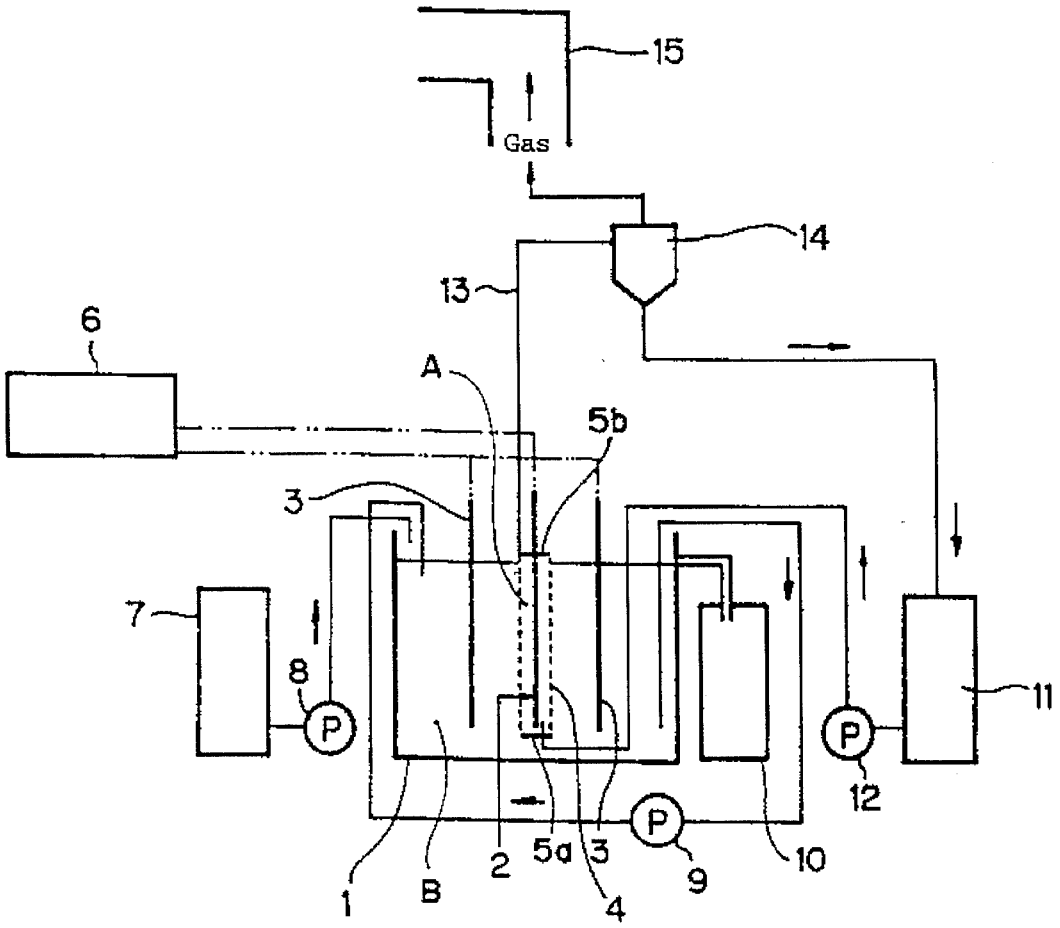
FIG. 1 is a schematic diagram showing an example of an apparatus for carrying out the method for electrowinning of indium of the present invention.

FIG. 1 shows an example of an apparatus for carrying out the method for electrowinning of indium of the present invention. In the figure, 1 is an electrolytic cell made of an acid-resistant material; 2 is an insoluble electrode (anode); 3 is a cathode; and 4 is a cation exchange membrane as "a cation diaphragm". 5*a* is a base plate; and 5*b* is a cover, which are fixed at the bottom and above the anode compartment A which is separated with a cation exchange membrane 4. 6 is a rectifier which is electrically connected with the insoluble electrode 2 and the cathode 3. The aboves are fundamental devices of the apparatus for electrowinning.

The high concentration indium solution in hydrochloric acid which is provided for the electrowinning is supplied from a supply solution tank 7 to a cathode compartment B with a pump 8 as a catholyte, and then the catholyte is circulated with a pump 9. If the catholyte overflows, the solution will be collected into an off solution tank 10. On the other hand, the anolyte is supplied from an anolyte tank 11 to an anode compartment A with a pump 12 and returned to the tank 11 through a separator 14 from the anode compartment A.

In FIG. 1, 13 is a pipeline which will pass the anolyte from the anode compartment A which is separated with the cation exchange membrane 4. The anolyte is fed at the bottom of the anode compartment A with the pump 12 and discharged from the upper end of the anode compartment A so that an oxygen gas which rises as bubbles can be almost completely captured. The pipeline 13 which passes the anolyte has one open end toward a gas-liquid separation box 14. The sulfuric acid solution which is separated from oxygen in the gas-liquid separation box 14 is returned to the anode tank 11. On the other hand, the separated oxygen is released outside through a duct 15 with a fan (not shown).

Figure 2:
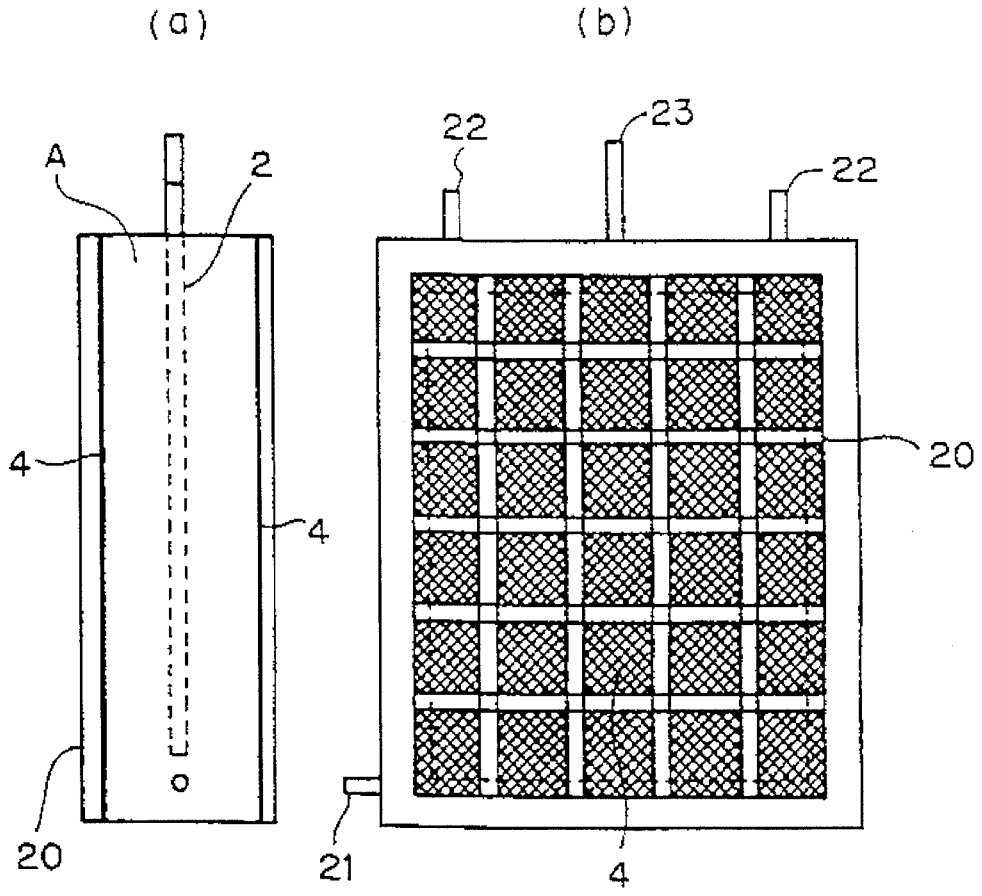
FIGS. 2(*a*) and 2(*b*) are a side view and an elevational view of an example of the anode compartment, respectively.
Figure 3:
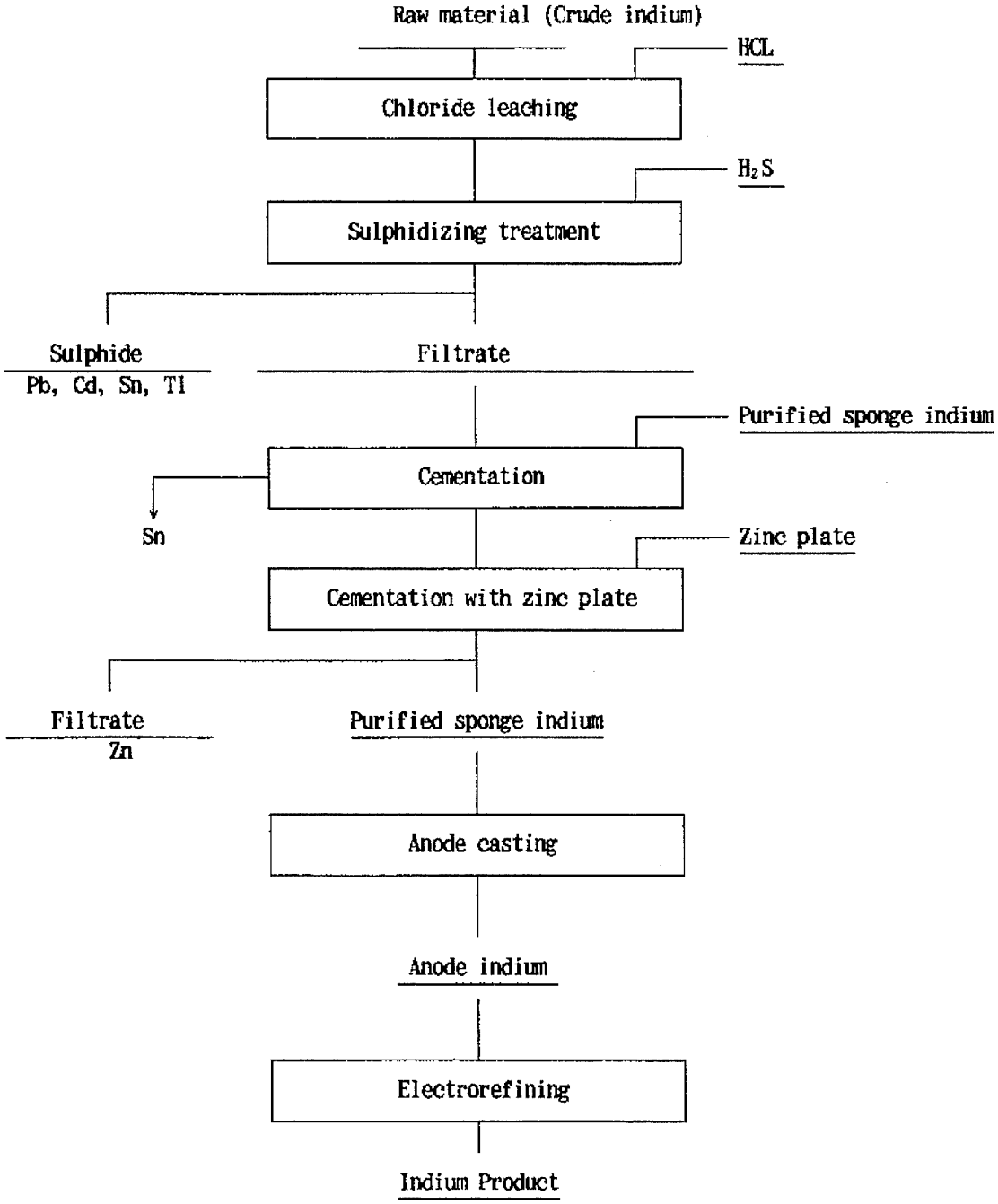
FIG. 3 (PRIOR ART)
FIG. 3 is a flow chart showing a conventional process which comprises casting a refined sponge indium and then carries out an electrorefining.

FIGS. 2(*a*) and 2(*b*) are a side view and an elevational view, respectively, showing specific structure of the anode compartment A as shown in FIG. 1.

The anode compartment A is a hexahedron-like container which is consisted of an exchange membrane supporting plate 20 and the cation exchange membrane 4 set on the inside of the plate and fixed together with an appropriate resin plate such as vinyl chloride with bolts. The front of the exchange membrane supporting plate 20 is parallel cross-like, and a cation can pass through the exchange membrane 4 by exposing the cation exchange membrane 4 through the gaps of the parallel crosses. 21 and 22 are an inlet for the anolyte and an outlet for the anolyte, respectively. 23 is an attachment site of electrical wirings.

A solution regulated as below by removing impurities by a chemical purification method from an indium hydrochloric acid solution obtained from a usual procedure at a factory, and by using purified water and a conc. hydrochloric acid was used as a primary catholyte (an electrolyte) and an electrowinning test was carried out 5 times continuously in an electrolytic cell as shown in FIG. 1.

| | | | |
|---|---|---|---|
| In | 27.8 g/L | Bi | <1 mg/L |
| Zn | 6.8 g/L | Cu | <1 mg/L |
| Pb | <1 mg/L | Sb | <1 mg/L |
| Cd | <1 mg/L | Fe | 66 mg/L |
| Sn | <1 mg/L | | |
| Tl | <1 mg/L | pH | 0.5 |

During the test, for the adjustment of the indium concentration, another indium hydrochloric acid solution (60 to 120 g/L of indium) which had been obtained from a procedure at a factory was continuously added to the electrolytic cell. As the cation diaphragm, SEREMION Exchange Membrane produced by Asahi Glass Co., Ltd. was used. The electrolytic conditions are as follows: the solution temperature: 30° C., the anolyte: 10 to 180 g/L-$H_2SO_4$, the volume of the cell: 133 L, and the circulation flow rate of the anolyte: 0.5 L/min. The other conditions are shown in Table 1.

TABLE 1

| Experiment Numbers | Electrode Anode Cathode Number of sheets | Charging Time(h) Current(A) | Current Density $Am^{-2}$ | Amount of electrodeposited metal/gram Theoretical amount Experimental result Gram | Current Efficiency Percent | Catholyte Circulation rate $Lmin^{-1}$ | Additive 1 kgIn Per gram | Interval between surfaces Distance millimeter |
|---|---|---|---|---|---|---|---|---|
| 1 | 1 | 116 h | 82.6 | 3644.3 | 96.4 | 4 | 1.35 | 190 |
| | 2 | 22 A | | 3514.0 | | | | |
| 2 | 2 | 86 h | 84.5 | 5526.4 | 98.0 | 4 | 2.70 | 180 |
| | 3 | 45 A | | 5416.2 | | | | |
| 3 | 1 | 67 h | 90.5 | 2305.8 | 99.6 | 8 | 2.70 | 180 |
| | 2 | 24 A | | 2295.9 | | | | |
| 4 | 1 | 48 h | 75.0 | 1645.1 | 98.5 | 12 | 5.40 | 180 |
| | 2 | 24 A | | 1621.0 | | | | |
| 5 | 1 | 100 h | 75.0 | 3444.3 | 99.2 | 14 | 13.50 | 180 |
| | 2 | 24 h | | 3417.1 | | | | |

In Table 1, the additives were glue and SAN-EKISU (sodium lignin sulphonate). The results of the electrowinning, and the composition of the electrolyte at the starting time and the ending time of the electrowinning of Test Nos. 1 to 5 are shown in Tables 2 to 16. Each analysis value in the results of the electrowinning is indicated in ppm. Remarks indicate the actual weight of the corresponding raw material. "Starting sheet" is an indium plate obtained from the conventional electrorefining by the present applicant, and "Electrodeposition and Starting sheet" is the composition and the weight of the cathode plate withdrawn from the electrolyte after the electrodeposition of indium by the electrowinning.

TABLE 2

| | Results of electrowinning | | | | | | | | | | |
|---|---|---|---|---|---|---|---|---|---|---|---|
| Experiment No. 1 | In | Pb | Cd | Sn | Tl | Zn | Bi | Cu | Sb | Fe | Remarks |
| Starting sheet | — | 1.2 | 1.5 | <0.1 | 0.3 | <0.1 | 0.2 | 0.8 | <0.1 | 0.1 | 1.24 kg |
| ectrodeposition + starting sheet | — | 9.0 | 0.4 | 1.4 | 0.3 | <0.1 | 0.6 | 3.7 | 1.4 | 0.1 | 4.75 kg |

TABLE 3

| | Composition of catholyte at the starting time of electrolysis | | | | | | | | | |
|---|---|---|---|---|---|---|---|---|---|---|
| Experiment No. 1 | In | Zn | Pb | Cd | Sn | Tl | Bi | Cu | Sb | Fe |
| Concentration (g/L) | 27.8 | 6.82 | — | — | — | — | — | — | — | — |
| Concentration (mg/L) — | | | <1 | <1 | <1 | <1 | <1 | <1 | <1 | 66 |

TABLE 4

| | Composition of catholyte at the ending time of electrolysis | | | | | | | | | |
|---|---|---|---|---|---|---|---|---|---|---|
| Experiment No. 1 | In | Zn | Pb | Cd | Sn | Tl | Bi | Cu | Sb | Fe |
| Concentration (g/L) | 26.2 | 12.4 | — | — | — | — | — | — | — | — |
| Concentration (mg/L) | — | — | <1 | <1 | <1 | <1 | <1 | <1 | <1 | 77 |

TABLE 5

| Experiment No. 2 | Results of electrowinning | | | | | | | | | | |
|---|---|---|---|---|---|---|---|---|---|---|---|
| | In | Pb | Cd | Sn | Tl | Zn | Bi | Cu | Sb | Fe | Remarks |
| starting sheet | — | 1.2 | 1.5 | <0.1 | 0.3 | <0.1 | 0.2 | 0.8 | <0.1 | 0.1 | 1.60 kg |
| Electrodeposition + starting sheet | — | 5.6 | 0.4 | 2.2 | 0.1 | <0.1 | 0.3 | 5.2 | 1.4 | 0.9 | 7.02 kg |

TABLE 6

| Experiment No. 2 | Composition of catholyte at the starting time of electrolysis | | | | | | | | | |
|---|---|---|---|---|---|---|---|---|---|---|
| | In | Zn | Pb | Cd | Sn | Tl | Bi | Cu | Sb | Fe |
| Concentration (g/L) | 26.1 | 12.2 | — | — | — | — | — | — | — | — |
| Concentration (mg/L) | — | — | <1 | <1 | <1 | <1 | <1 | <1 | <1 | 80 |

TABLE 7

| Experiment No. 2 | Composition of catholyte at the ending time of electrolysis | | | | | | | | | |
|---|---|---|---|---|---|---|---|---|---|---|
| | In | Zn | Pb | Cd | Sn | Tl | Bi | Cu | Sb | Fe |
| Concentration (g/L) | 21.3 | 13.8 | — | — | — | — | — | — | — | — |
| Concentration (mg/L) | — | — | <1 | <1 | <1 | <1 | <1 | <1 | <1 | 56 |

TABLE 8

| Experiment No. 3 | Results of electrowinning | | | | | | | | | | |
|---|---|---|---|---|---|---|---|---|---|---|---|
| | In | Pb | Cd | Sn | Tl | Zn | Bi | Cu | Sb | Fe | Remarks |
| Starting sheet | — | 1.5 | 1.3 | 0.3 | 0.3 | <0.1 | <0.1 | 0.6 | <0.1 | 0.1 | 0.68 kg |
| Electrodeposition + starting sheet | — | 2.3 | 0.3 | 2.4 | 0.1 | <0.1 | 0.1 | 1.3 | 0.2 | 0.9 | 2.97 kg |

TABLE 9

| Experiment No. 2 | Composition of catholyte at the starting time of electrolysis | | | | | | | | | |
|---|---|---|---|---|---|---|---|---|---|---|
| | In | Zn | Pb | Cd | Sn | Tl | B | Cu | Sb | Fe |
| Concentration (g/L) | 21.3 | 13.8 | — | — | — | — | — | — | — | — |
| Concentration (mg/L) | — | — | <1 | <1 | <1 | <1 | <1 | <1 | <1 | 56 |

TABLE 10

| Experiment No. 3 | Composition of catholyte at the ending time of electrolysis | | | | | | | | | |
|---|---|---|---|---|---|---|---|---|---|---|
| | In | Zn | Pb | Cd | Sn | Tl | Bi | Cu | Sb | Fe |
| Concentration (g/L) | 41.2 | 13.5 | — | — | — | — | — | — | — | — |
| Concentration (mg/L) | — | — | <1 | 3 | <1 | <1 | <1 | <1 | <1 | 60 |

TABLE 11

| Experiment No. 4 | Results of electrowinning | | | | | | | | | | |
|---|---|---|---|---|---|---|---|---|---|---|---|
| | In | Pb | Cd | Sn | Tl | Zn | Bi | Cu | Sb | Fe | Remarks |
| Starting sheet | — | 1.5 | 1.3 | 0.3 | 0.2 | <0.1 | <0.1 | 0.6 | <0.1 | 0.1 | 1.04 kg |
| Electrodeposition + starting sheet | — | 2.6 | 0.3 | 2.1 | 0.1 | <0.1 | <0.1 | 1.0 | 0.2 | 0.1 | 2.66 kg |

TABLE 12

| | Composition of catholyte at the starting time of electrolysis | | | | | | | | | |
|---|---|---|---|---|---|---|---|---|---|---|
| Experiment No. 4 | In | Zn | Pb | Cd | Sn | Tl | Bi | Cu | Sb | Fe |
| Concentration (g/L) | 41.2 | 13.5 | — | — | — | — | — | — | — | — |
| Concentration (mg/L) | — | — | <1 | 3 | <1 | <1 | <1 | <1 | <1 | 60 |

TABLE 13

| | Composition of catholyte at the ending time of electrolysis | | | | | | | | | |
|---|---|---|---|---|---|---|---|---|---|---|
| Experiment No. 4 | In | Zn | Pb | Cd | Sn | Tl | Bi | Cu | Sb | Fe |
| Concentration (g/L) | 42.8 | 15.3 | — | — | — | — | — | — | — | — |
| Concentration (mg/L) | — | — | <1 | 2 | <1 | <1 | <1 | <1 | <1 | 55 |

TABLE 14

| | Results of electrowinning | | | | | | | | | | |
|---|---|---|---|---|---|---|---|---|---|---|---|
| Experiment No. 4 | In | Pb | Cd | Sn | Tl | Zn | Bi | Cu | Sb | Fe | Remarks |
| Starting sheet | — | 1.5 | 1.3 | 0.3 | 0.2 | <0.1 | <0.1 | 0.6 | <0.1 | 0.1 | 1.01 kg |
| Electrodeposition + starting sheet | — | 3.1 | 0.5 | 3.1 | 0.1 | <0.1 | 0.1 | 1.7 | 0.2 | 0.1 | 4.43 kg |

TABLE 15

| | Composition of catholyte at the starting time of electrolysis | | | | | | | | | |
|---|---|---|---|---|---|---|---|---|---|---|
| Experiment No. 4 | In | Zn | Pb | Cd | Sn | Tl | Bi | Cu | Sb | Fe |
| Concentration (g/L) | 42.8 | 15.3 | — | — | — | — | — | — | — | — |
| Concentration (mg/L) | — | — | <1 | 2 | <1 | <1 | <1 | <1 | <1 | 55 |

TABLE 16

| | Composition of catholyte at the ending time of electrolysis | | | | | | | | | |
|---|---|---|---|---|---|---|---|---|---|---|
| Experiment No. 4 | In | Zn | Pb | Cd | Sn | Tl | Bi | Cu | Sb | Fe |
| Concentration (g/L) | 43.3 | 17.1 | — | — | — | — | — | — | — | — |
| Concentration (mg/L) | — | — | <1 | 2 | <1 | <1 | <1 | <1 | <1 | 68 |

Chlorine gas: when the chlorine gas concentration upon the electrolytic cell was periodically measured with a chlorine gas detecting tube during Test Nos. 1 to 5, chlorine gas could not been detected, whereby it was confirmed that the generation of chlorine gas could be prevented.

Current efficiency: The current efficiency in Test Nos. 1 to 5 was 96% or more, and was comparable to that in a current electrorefining.

Grade of deposited metal: the content of a metal which is nobler than indium was higher than that in a usual cathode in Test Nos. 1 and 2. In the other tests, however, the content of the nobler metals was decreased in the tests carried out thereafter.

With the constitution of the present invention as described above, it has become possible to carry out a direct electrowinning of indium from an indium-containing hydrochloric acid solution while preventing the generation of chlorine gas, and a step for casting an anode can be omitted with the result that an energy saving and an increased productivity have become possible.

The grade of electrowinning indium is high, comparably to that in a usual ectrorefining product.

What is claimed is:

1. A method for recovering indium for indium solution which has been purified by a channel purification method, comprising:

using sulfuric acid solution as an anolyte for an anode compartment equipped with an insoluble anode, using an indium-containing hydrochloric acid solution as a catholyte for a cathode compartment, separating said cathode compartment and said anode compartment with a cation exchange membrane; and conducting an electrowinning step to recover indium from said indium-containing hydrochloric acid solution.

2. The method for recovering indium according to claim 1, wherein the sulfuric acid solution is circulated inside and outside the anode compartment.

3. The method for recovering indium according to claim 2, wherein during said conducting step, oxygen gas is generated in said anode compartment and said oxygen gas and said anolyte are circulated to a gas-liquid separation box to separate said oxygen gas from said anolyte and to lower voltage during said electrowinning step.

4. The method for recovering indium according to claim 1, wherein during said conducting step, oxygen gas is generated in said anode compartment and said oxygen gas and said anolyte are circulated to a gas-liquid separation box to separate said oxygen gas from said anolyte and to lower voltage during said electrowinning step.

5. The method for recovering indium according to claim 1, wherein the sulfuric acid concentration of the sulfuric acid solution is 10 to 180 g/L.

6. The method of claim 1 wherein a starting sheet made of a high grade of indium obtained by electrowinning or electrorefining is selected as said cathode sheet.

7. The method of claim 1 wherein a glue and a sodium lignin sulphonate are added in an amount of less than 10 g/kg of electrodeposited indium to said catholyte to minimize bubbling during electrodeposition.

8. The method of claim 1 further comprising the steps of forming said anode compartment with a top, bottom and sides to enclose said insoluble anode, at least said sides being formed of said cation exchange member and disposing said anode compartment within said cathode compartment;

conducting an electrowinning step to recover indium in said cathode compartment while removing said anolyte and oxygen generated during said electrowinning step from a top of said anode compartment; and separating said oxygen from said anolyte and returning said anolyte to the bottom of said anode compartment.

9. The method of claim 1 wherein said catholyte is recirculated to said cathode compartment.

10. A method for recovering indium comprising:

purifying a catholyte to be used in a subsequent step for recovering indium by carrying out an electrolysis in place of a chemical purification method wherein a sulfuric acid solution is used as an anolyte for an anode compartment equipped with an insoluble anode, a hydrochloric acid solution is used as a catholyte for a cathode compartment, while separating the cathode compartment and the anode compartment with a cation exchange membrane, said electrolysis removing and recovering elements present in the catholyte more noble than indium so that indium recovered in said subsequent step is of high purity, and supplementing the cathode compartment with an indium-containing hydrochloric acid solution after said purifying step, supplementing the anode compartment with a sulfuric acid solution, and;

conducting an electrowinning of indium while separating the cathode compartment and the anode compartment with a cation exchange membrane to recover said indium.

* * * * *